United States Patent [19]

Cislak

[11] 4,157,687

[45] Jun. 12, 1979

[54] METHOD AND APPARATUS FOR AUTOMATICALLY SEWING BELTS

[75] Inventor: Raymond S. Cislak, Chicago Heights, Ill.

[73] Assignee: Gateway Industries, Inc., Chicago, Ill.

[21] Appl. No.: 840,956

[22] Filed: Oct. 11, 1977

[51] Int. Cl.[2] ..... D05B 23/00

[52] U.S. Cl. ..... 112/121.27; 112/121.12; 112/147; 112/262.3

[58] Field of Search ..... 112/121.25, 121.27, 112/121.12, 121.11, 147, 121.29, 279, 121.15, 262; 156/93, 202, 227; 2/338; 280/290

[56] References Cited

U.S. PATENT DOCUMENTS

| | | | |
|---|---|---|---|
| 3,151,583 | 10/1964 | Troll et al. | 112/121.11 |
| 3,670,679 | 6/1972 | Campbell | 112/121.27 X |
| 3,776,162 | 12/1973 | Scholl | 112/121.15 |
| 3,785,907 | 1/1974 | Barr et al. | 156/202 X |
| 3,832,960 | 9/1974 | Mayer et al. | 112/279 X |

*Primary Examiner*—Werner H. Schroeder
*Assistant Examiner*—Andrew M. Falik
*Attorney, Agent, or Firm*—Fitch, Even & Tabin

[57] ABSTRACT

A method and apparatus are disclosed for forming a loop in a seat belt and stitching the looped belt plies together. One sewing machine performs the strength forming stitch pattern such as the butterfly stitch and it is used as a master sewing machine whose sewing time of operation is maximized. During the stitching of butterfly pattern, another seat belt will have been fed into a loop forming means at which a loop is formed and its looped belt plies will have been tacked together by another sewing machine sewing a zigzag stitch. An automatic transfer means transfers looped belts from the first sewing station to the butterfly stitching machine. An automatic bobbin changing apparatus is also provided.

23 Claims, 14 Drawing Figures

METHOD AND APPARATUS FOR AUTOMATICALLY SEWING BELTS

This invention relates to a method of and an apparatus for folding an end of a safety belt into a loop and to sewing the plies together which form the loop.

This invention is directed to the forming of a looped end at one end of a safety belt by transversely folding one end portion over onto itself to provide superimposed plies which then are stitched together by a sewing machine with sufficient stitches to hold the loop against high tensile loading in order to meet Federal Regulations and safety standards for seat belt systems used in vehicles. In some instances, an anchor plate, tongue plate or buckle is included within and captured in the loop and in other instances the loop is empty when formed. The empty loop later receives a shaft or spindle of a retractor reel used for retracting the safety belt. With current government regulations, usually six seat belt assemblies are included in new automobiles having a back seat therein. The present invention will be described in detail in connection with the formation of an empty loop in a seat belt although it is applicable to forming belt loops having threaded therein a tongue plate, anchor plate or buckle.

In present commercial installations, the empty belt loops for receiving a retractor spindle are folded manually and sewn at two different locations by two different sewing machine operators. More specifically, an unfolded belt is taken manually by a first sewing machine operator who folds a loop at one end of the belt and then sews a stitch pattern across the belt, usually a zigzag stitch pattern having 47 stitches for the usual safety belt width of one and 15/16th inches. The zigzag stitch pattern primarily secures the upper ply to the underlying ply and forms the definite length of loop for the loop. The belt is later manually inserted by a second sewing machine operator in a second sewing machine which sews a strength holding stitch having a number of lines of stitching therein usually in box or butterfly stitch pattern, the butterfly pattern having 168 stitches. This strength stitch pattern takes a considerably longer period of time to sew than the time required to sew a single line of stitches of the zigzag stitch pattern. More specifically, one zigzag machine operator is able to fold and stitch sufficient looped belts to supply two butterfly stitch sewing machine operators.

Current practice is to use industrial sewing machines of a conventional manufacture, such as the Singer Model No. 269, which has an underlying stitch pattern control cam which completes the butterfly stitch pattern within a 360 degree movement of the cam. The latter shifts a shuttle holding the looped belt through a predetermined pattern of movement relative to the sewing needle to sew the lines of stitches with the thread. The thread is carried in a bobbin mounted in a bobbin case at a location beneath the cam, and the bobbin contains sufficient wound thread for sewing ten butterfly stitches. In current practice, the operator will take a stack of ten belts and then after sewing the tenth belt, the operator will reach under the cam for the bobbin casing and remove the bobbin casing having the spent bobbin therein. The bobbin casing is opened and the spent bobbin is extracted. An end of the thread from the new bobbin is then threaded by the operator into a hook eye in the bobbin casing. The operator reinserts the newly loaded bobbin casing into the machine for sewing the next ten belts.

When one considers the thousands of seat belt assemblies made in a given day and that a typical production rate of about 408 safety belt loops per hour using one zigzag sewing machine operator and two butterfly sewing machine operators, it can be seen that the current practice is a labor intensive method. Certain proposals have been made in the prior art such as disclosed in U.S. Pat. Nos. 3,898,119 and 3,785,907 to automate the formation of a loop and its attachment to an anchor plate, but these systems were not stitching systems concerned with the time involved in the sewing of a strength stitch, such as a butterfly stitch, the time of changing thread bobbins or their relationship to the total belt stitching process. Thus, there is a need for an improved process and apparatus to supplant the labor intensive manual system now in use.

Accordingly, a general object of the invention is to provide a new and improved, as contrasted to the prior art, method and apparatus for forming a belt loop and sewing the overlap plies of a safety belt.

Other objects and advantages of the invention will become apparent from the following detailed description taken in connection with the accompanying drawings in which.

Figure 2A:
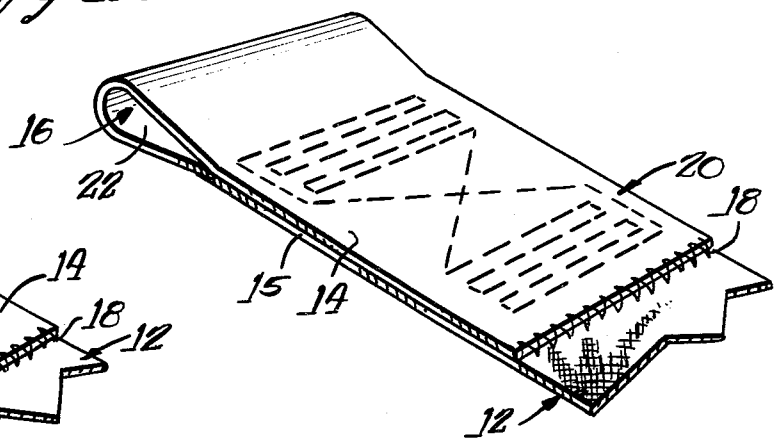
FIG. 2 is a diagrammatic illustration of a belt loop attached with a zigzag switch.

FIG. 2*a* is a diagrammatic view of a seat belt having a zigzag stitch and a strength butterfly stitch securing the superimposed plies together.

Figure 1:
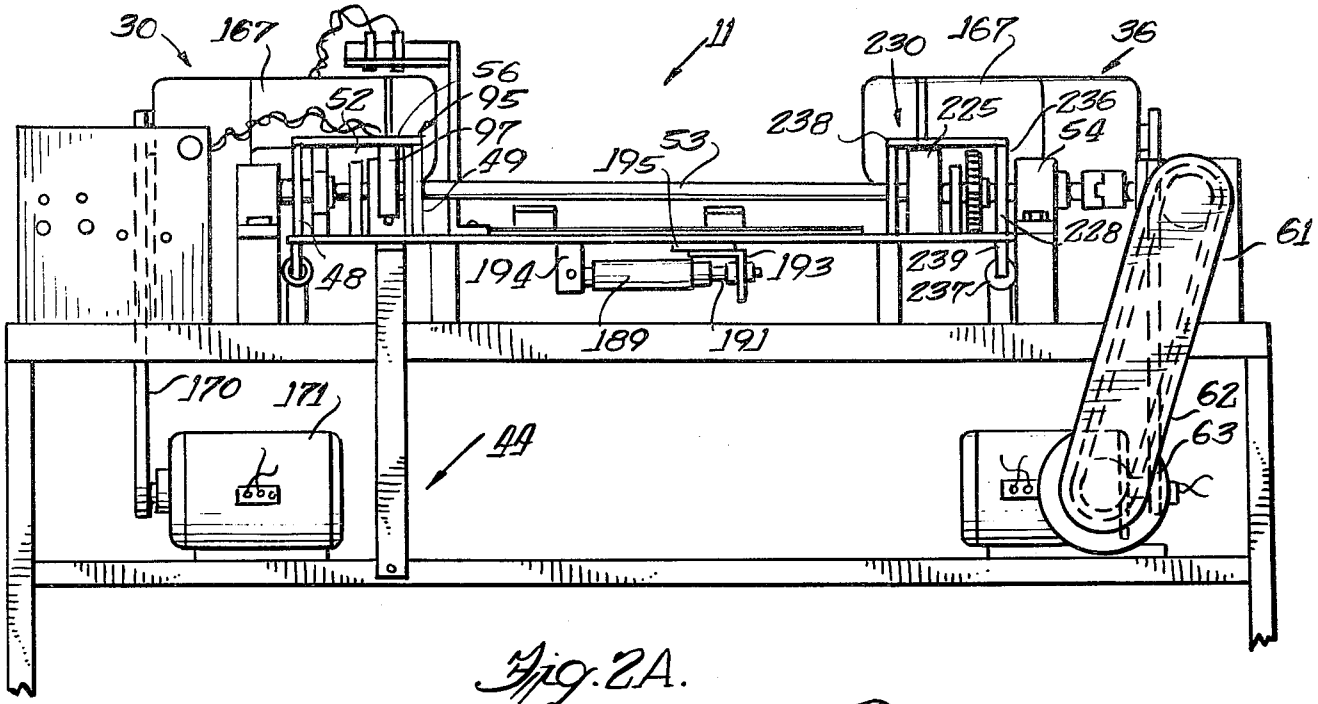
FIG. 1 is a side elevational view of an apparatus embodying the invention and for practicing the method.
Figure 3:
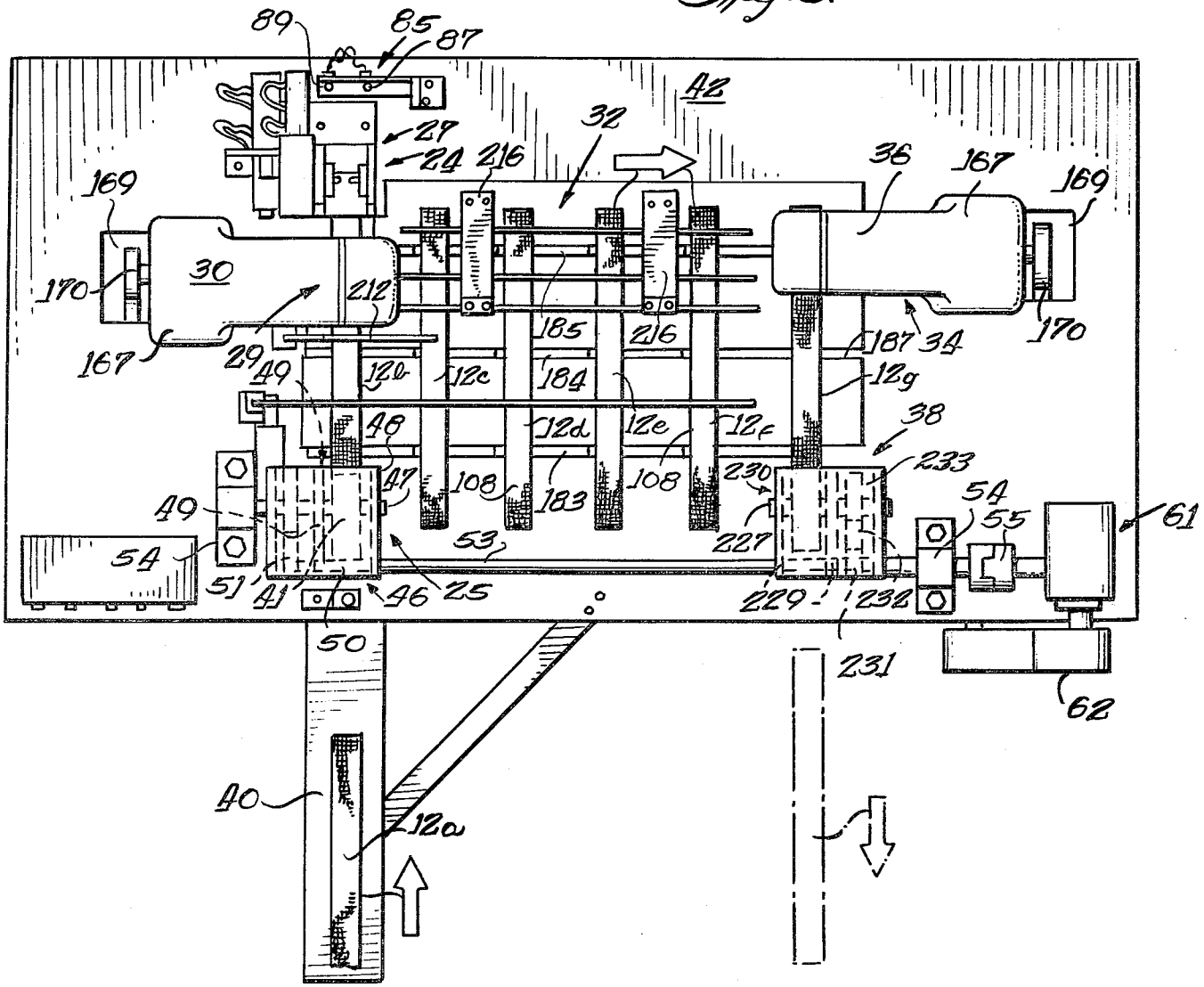

FIG. 3 is a plan view of the apparatus of FIG. 1.

Figure 4:
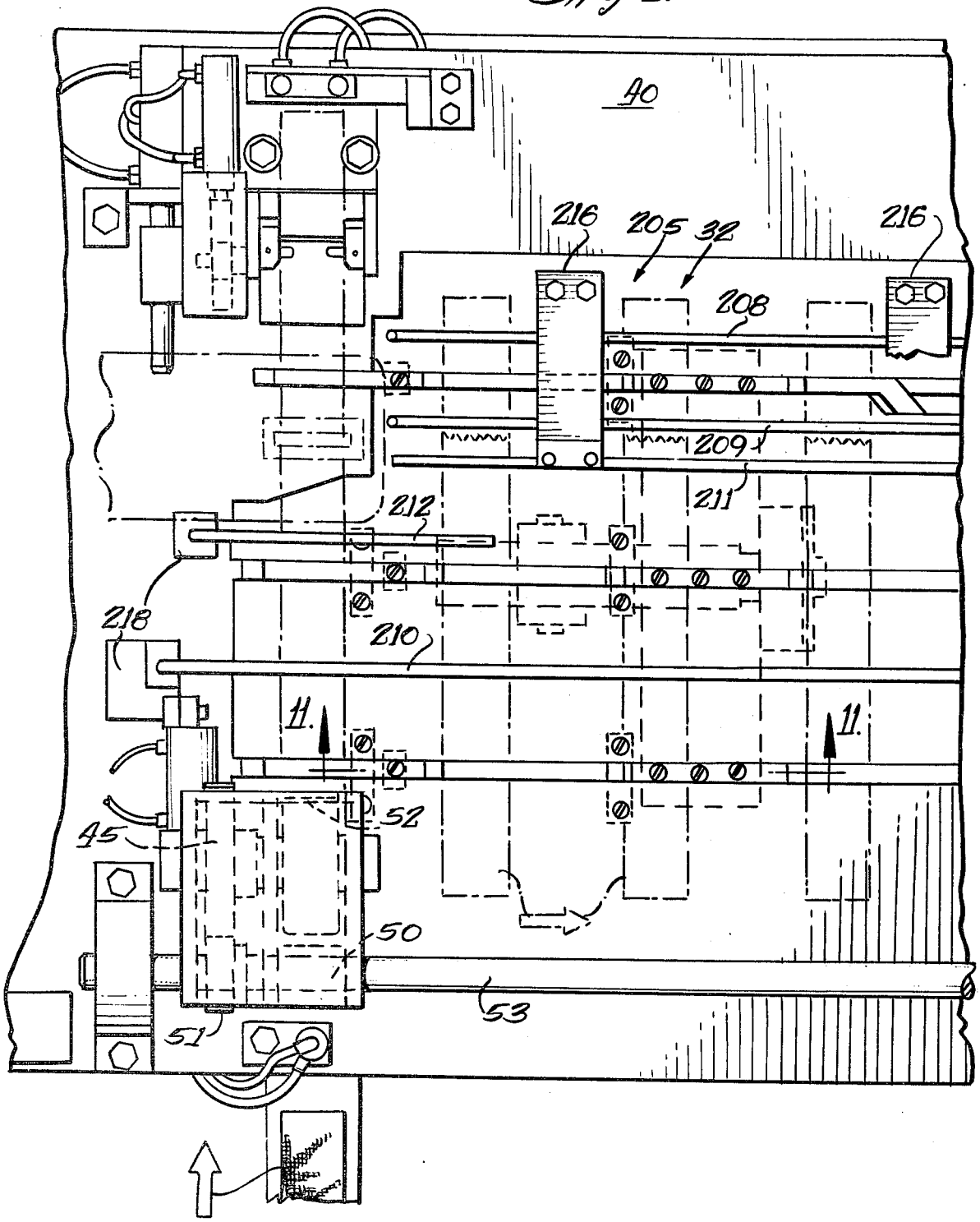

FIG. 4 is a partial plan view of the apparatus of FIG. 1 showing the belt infeed and folding stations.

Figure 5:
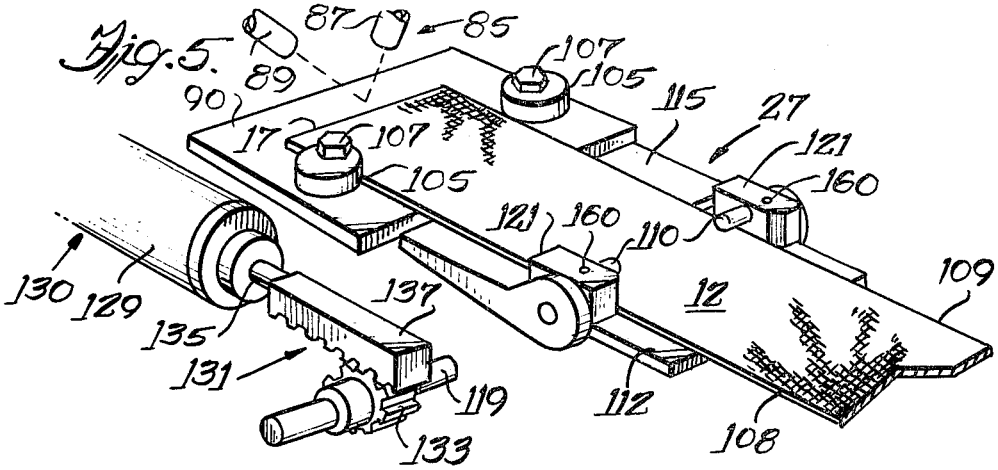
Figure 6:
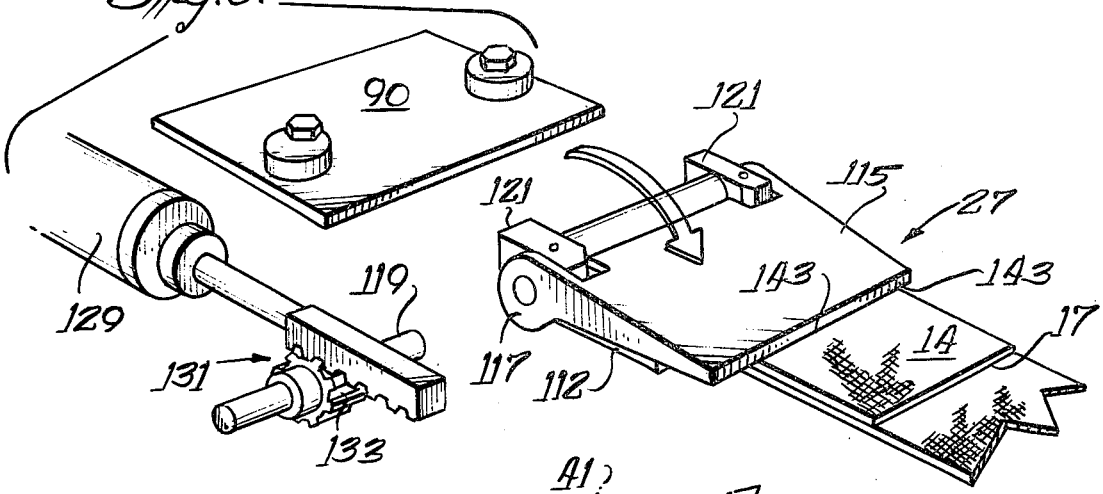

FIGS. 5 and 6 are diagrammatic illustrations of the belt folding means.

Figure 7:
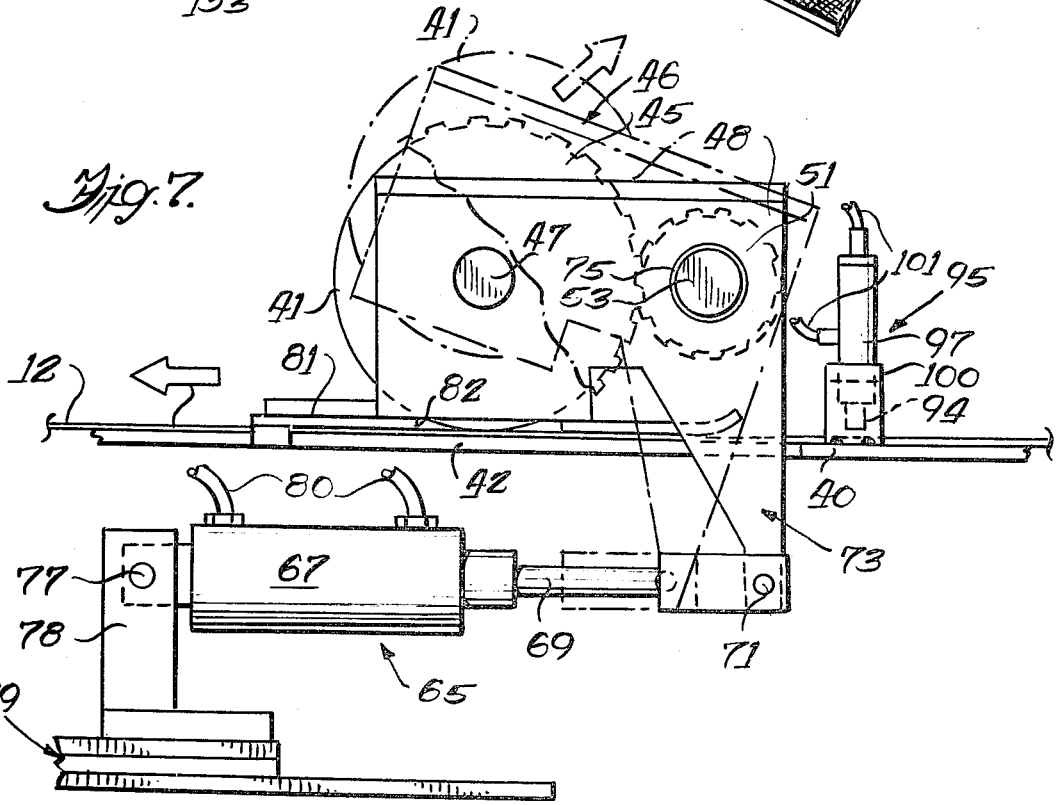

FIG. 7 is a view illustrating the means for controlling the selective operation of the means for infeeding the belt to the folding station.

Figure 8:
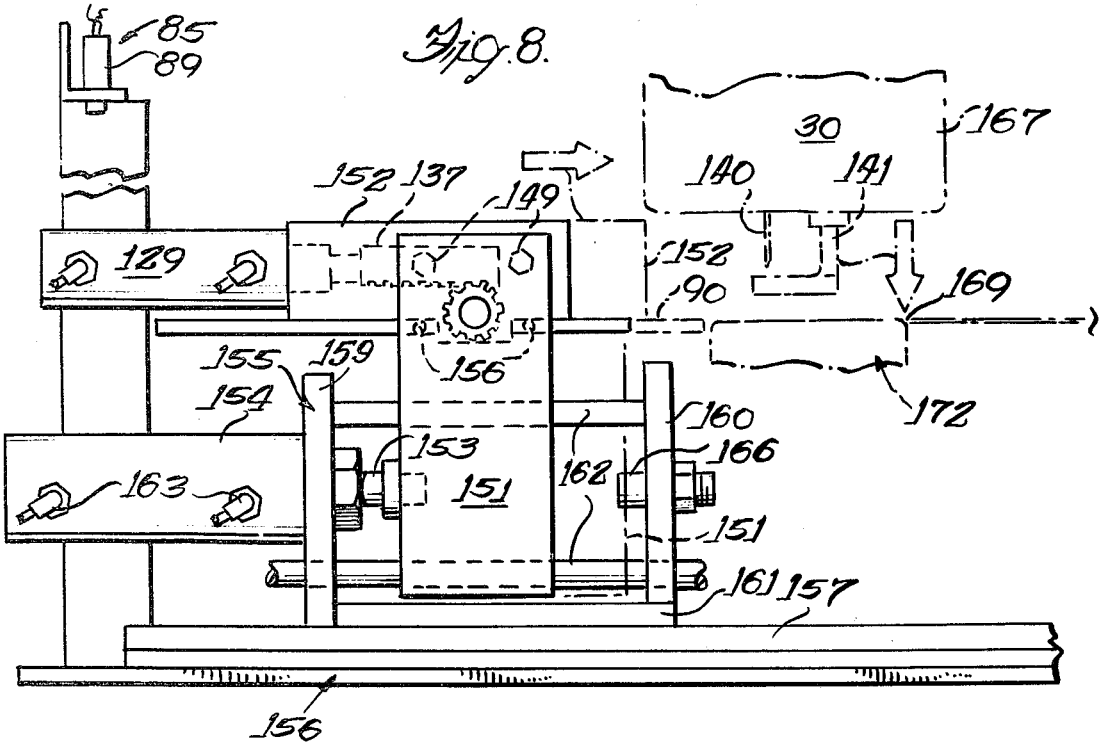

FIG. 8 is a side elevational view showing the carriage for moving the folded belt to a position to receive a zigzag stitch.

Figure 9:
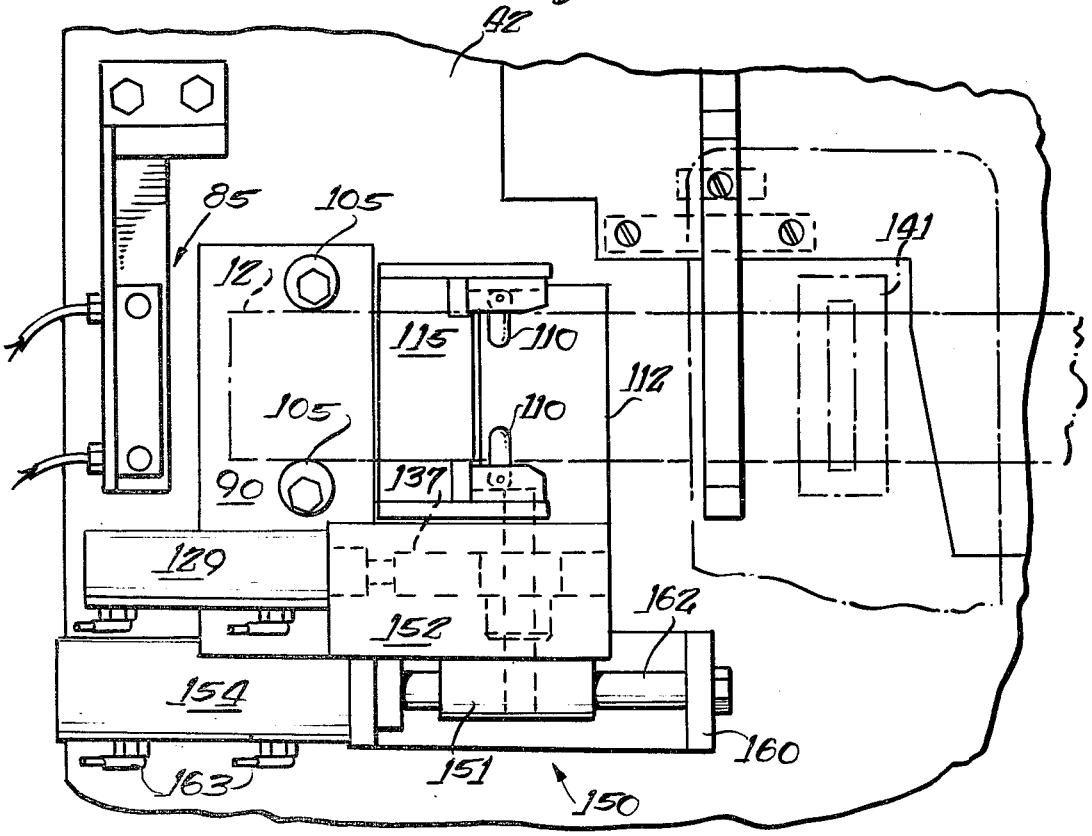

FIG. 9 is a plan view showing the apparatus shown in FIG. 8.

Figure 10:
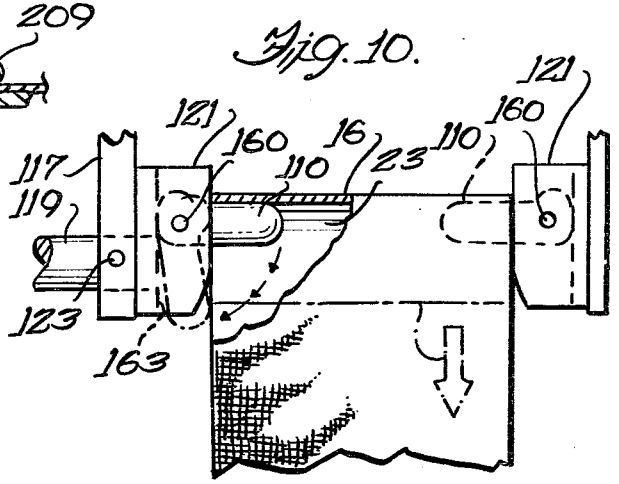

FIG. 10 is a fragmentary view showing the belt folding fingers.

Figure 11:
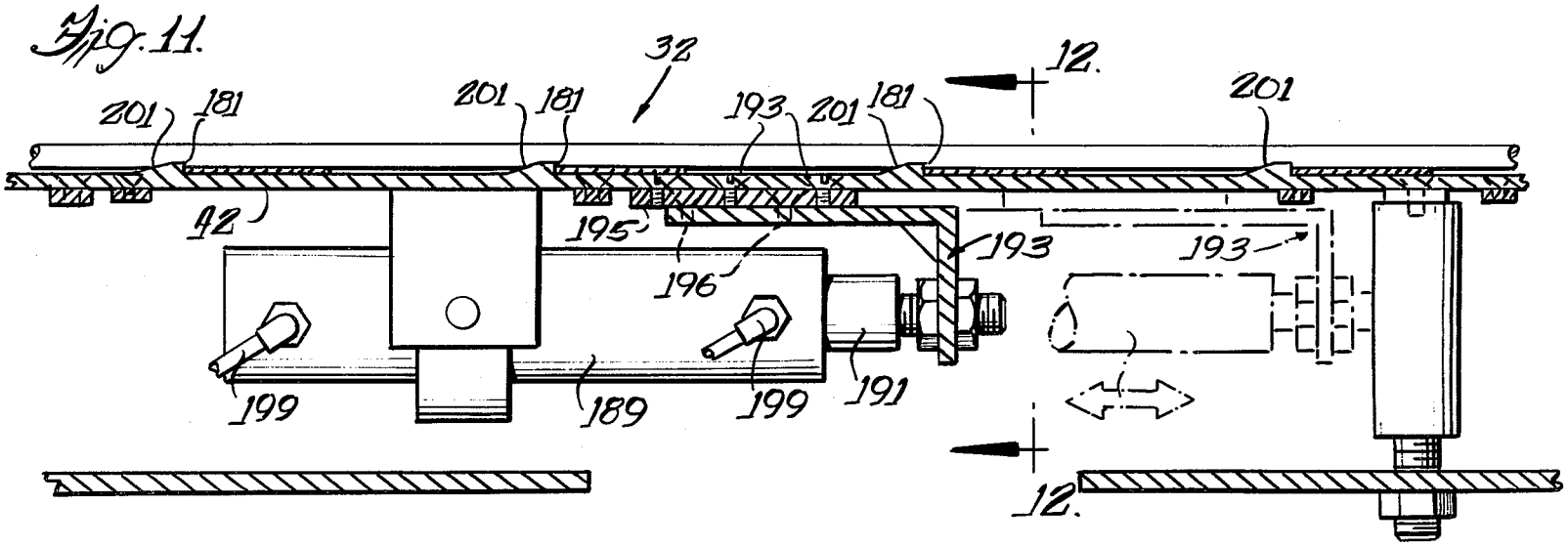

FIG. 11 is a cross-sectional view taken substantially along the line 11—11 in FIG. 4 illustrating the preferred transfer means for transferring belt to the strength stitch station.

Figure 12:
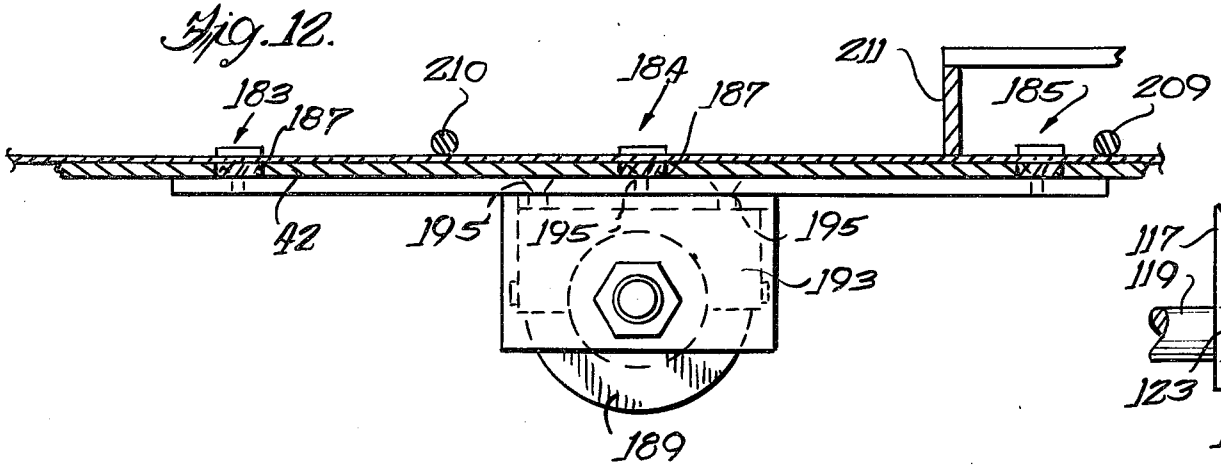

FIG. 12 is a cross-sectional view taken substantially along the line 12—12 in FIG. 11.

Figure 13:
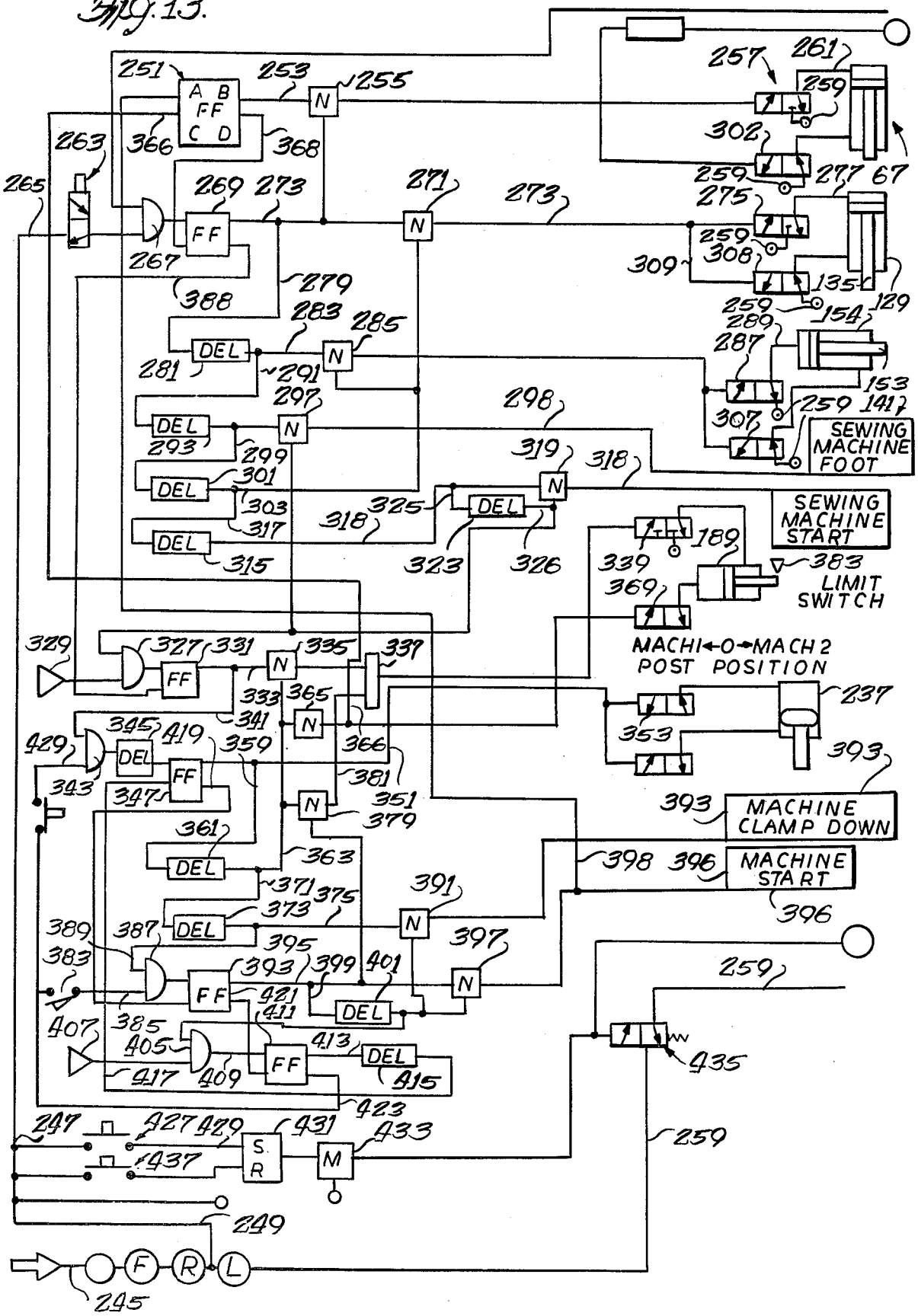

FIG. 13 is a schematic diagram illustrating the control system for operating the apparatus of FIG. 1.

Figure 2:
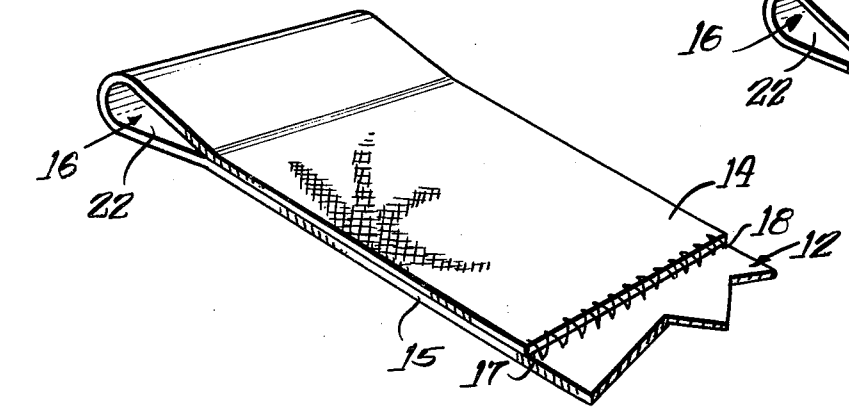

As shown in the drawings for purposes of illustration, the invention is embodied in an apparatus 11 which receives a seat belt 12 in the form of a length of web of woven nylon or polyester and folds an end 14 of the belt back onto itself to form a ply in superimposed relationship with an underlying ply 15 of the belt. The folded belt produces a looped end 16 which in this instance is shown empty. A forward edge 17 of the belt is secured to the underlying ply 15 by a first sewing operation which forms a first line of stitches 18, herein a zigzag stitch pattern, as shown in FIG. 2. The zigzag stitches 18 do provide sufficient strength to hold the superimposed plies in a looped condition against heavy tensile loadings. Therefore, the belt loop 16 is provided with a second strength forming line of stitches 20. Herein, the stitches 20 are in the form of a butterfly stitch pattern although in some instances commercial belt loops are sewn with stitches 20 in a box stitch pattern. Thus, when a retractor spindle shaft is inserted into a hollow opening 22 formed between the upper and lower plies 14 and 15 and a high tensile loading is applied to the belt 12, the stitches 18 and 20 hold the loop plies against separating.

The typical butterfly stitch pattern 20 is made with 168 individual stitches and takes several times longer to sew than it takes to sew the 47 individual stitches used to make the zigzag stitch pattern 18. For presently used commercial machines, only ten belts are sewn with a butterfly stitch pattern to exhaust the conventional thread containing bobbin. The manual replacement of bobbins is a time consuming operation. The time relationships for the current practice is that a machine operator manually folds superimposed plies 14 and 15 and forms the zigzag stitch with a first sewing machine at a rate sufficient to supply two operators each operating a separate butterfly stitching machine. By way of example only, the three machine operators will loop and sew about 408 belts per hour. Thus, it will be seen that the present practice is a labor intensive one to produce thousands of belts per hour needed for the automotive industry.

In accordance with the present invention, a single operator using the apparatus 11 may fold and sew several times the production rate of three operators using the manual system thereby increasing productivity and substantially reducing the labor costs involved in safety belt loop forming and sewing operations. To this end, the belt loops are formed and sewn by a method in which a second sewing machine 36 at a second sewing station 34 is kept substantially continually sewing by sewing on one belt **12*g* thereat to form the 168 stitches while simultaneously another belt 12*b* has been folded by a folding means 27 at a folding station 24 and then sewn with 47 stitches of the zigzag pattern. Also, in accordance with a preferred method, the bobbins for the sewing machines 30 and 36 are changed automatically and, preferably, during the time of discharge feeding a belt 12*g* from the second sewing machine and infeeding the next belt 12*f* to the second sewing machine. In this manner, the bobbin changing is a time free operation. The illustrated and preferred method comprises the steps of: a belt 12*a* (FIG. 3) is fed forwardly to a loop forming and folding station 24 by a belt feeding means 25 with one end of the belt being folded over, as best seen in FIGS. 5 and 6, by a belt folding means 27 and then a sewing means at a first sewing station 29 secures the belt plies together by a zigzag stitch 18 with a first sewing machine 30. In the preferred method, a transfer means 32 shifts each belt laterally from the first sewing station, as viewed in FIG. 3, through each of several positions shown as occupied by belts 12*c*, 12*d*, 12*e* and 12*f* to a second sewing station 34 at which is a second sewing means in the form of a sewing machine 36 for sewing the strength forming stitch 20. In the preferred method, a sewn belt 12*g*, such as shown in FIG. 3, is then fed outwardly by a discharge feed means 38 from the apparatus as diagrammatically shown by the arrow in FIG. 3**.

In accordance with the most important aspect of the invention, the butterfly machine 36 is operated almost substantially continuously except for the very short periods of time in which it takes to have the transfer means 32 shift a belt into position beneath its sewing needle and to eject the previously sewn belt by the discharge feed means 38. Preferably, the bobbin and its casing are changed automatically during a belt transfer operation so that the bobbin change time is substantially eliminated when considered in relationship to the amount of time used for the manual operator to remove the bobbin casing from the machine and supply a new bobbin and to thread the eye of the hook of the bobbin casing before inserting the bobbin casing into the machine. Likewise, it has been found that there is sufficient time during the stitching of the butterfly stitch to infeed a new belt to fold the same, position the same under the zigzag stitching machine 30 and to form the zigzag stitch. Thus, only two sewing machines may be needed to provide an output substantially as provided by three machines with the manual system used hereinbefore. This is obtained by keeping the butterfly stitching machine 36 operating substantially continuously except for the brief removal of one belt and insertion of one belt which is done automatically.

Referring now in greater detail to the illustrated apparatus 11, a supply of individual belts which may be precut and stacked (not shown) or in roll from which a belt length is cut is positioned on a horizontal supporting infeed plate 40 (FIG. 3) for travel forwardly to the feeding means 25 which will feed the belt automatically beneath the sewing machine 30 and into proper position within the folding means 27 at the folding station 24. Herein, the infeeding means 25 comprises a driving feed wheel 41, FIGS. 3 and 7, mounted above a stationary main top plate 42 which supports not only the belt **12*a* being fed inwardly but also the other belts 12*c*, 12*d*, 12*e*, 12*f* and 12*g*, as will be explained. The top plate 42 is supported by a table-like frame means 44**.

A belt **12*a* is inserted beneath the feed wheel 41 for forward feeding to the left, as viewed in FIG. 7, and the feed wheel 41 is rotated in the clockwise direction, as viewed in FIG. 7, by means of a continually rotating driven gear 45 fixed to a shaft 47 on which is also fixed the feed wheel 41. The shaft 47 is supported for rotation in a housing 46 comprising a pair of spaced outer housing plates 48 and 49 joined together by an overhead plate 56 (FIG. 1). The shaft 47 is journaled for rotation in bearings in the housing plates 48 and 49. An intermediate third upstanding plate 52 also is joined to the overhead plate 56 FIG. 1. The gear 45 is driven by a pinion gear 51 which is fixed to an elongated drive shaft 53 which extends to and is common with the drive 38 for the discharge feed means 38. The drive shaft 53 extends across the top plate 42 between pillow blocks 54 each having a bearing journaling the drive shaft for rotation. The drive shaft at its right end, as viewed in FIG. 3, is connected by a coupling 55 to a speed reducing gear box drive 61 which is driven by a belt drive 62 driven by an electric motor 63, as best seen in FIG. 1. As will be described hereinafter, the outfeed discharge means 38 is substantially identical in construction to the infeed drive means 25** described above.

The preferred manner of selectively engaging the belt drive wheel 41 with the belt 12 is by a feed actuating means 65, as best shown in FIG. 7, which normally pivots the housing 46 and the feed wheel 41 to its upper position spaced above the belt 12 and the underlying plate 42, as shown in phantom lines in FIG. 7. As will be explained, at the time of finishing of the stitching operations at both the first and second sewing stations 29 and 34, the actuating means lowers the feed wheel 41 to engage and to propel the belt 12*a* forwardly until it is automatically stopped by a length sensing means which again actuates the actuating means 65 to raise the feed wheel 41 thereby stopping the feed.

The preferred actuating means 65 comprises a pneumatic actuator cylinder 67 (FIG. 7) having a piston rod 69 connected by a pin 71 to a depending end 73 of the outer housing plate 48 for the housing which supports the feed wheel 41 and its rotatable shaft 57. The housing plates 48, 49 and 52 are journalled by cylindrical bearing members 75 which are mounted in the outer housing plates 48 and 49 and through which extends the shaft 53 for turning about the shaft's axis as the pneumatic cylinder means 67 is operated to pivot the feed wheel between the lower feeding position shown in solid lines in FIG. 7 and the upper nonfeeding position shown in phantom lines in FIG. 7. The pneumatic cylinder means 67 is suitably mounted by a pin 77 to a bracket 78 carried on a portion of the supporting frame 79. The actuating pneumatic cylinder 67 is provided with a pair of pneumatic hoses 80 for reciprocating the piston 69 in the forward and aft directions.

Preferably, a flat holddown plate 81 (FIG. 7) is pivotally carried by the housing 46 and extends beneath and has an aperture 82 therein through which projects the feed wheel 41. The flate plate extends from the feed wheel to a location closely adjacent the sewing station 29 so that the leading end of the belt will not rise from the bottom plate 42 as the belt is fed through its path of travel into and through the first sewing station and into the folding station. The holdown plate 81 has an upturned leading end beneath which the operator inserts the leading end of a belt.

The preferred manner of terminating the belt infeed is by means of a leading end detector means 85 (FIGS. 3 and 5) which, in this instance, is in the form of a photocell means having a light source 87 and a photocell receiver 89 for receiving light reflected upwardly from the underlying stationary plate 42. When the leading edge 17 of the belt, as best seen in FIGS. 3 and 5, interrupts the light beam, the photocell detector means 85 causes operation of the actuating cylinder 67 to retract its piston 69 thereby lifting the feed wheel 41 from the belt. To further stop and hold the belt, particularly against any retrograde movement, a clamping means 95 (FIGS. 1 and 7) which is operated to clamp the belt against the infeed plate 40. Herein, the clamping means 95 comprises a pneumatic cylinder 97 having a plunger piston 99 located above the belt for downward movement into engagement with the belt when the pneumatic cylinder 97 is operated through one of its pneumatic hoses 101. The cylinder 97 is mounted on an L-shaped bracket 100 which is secured to the top plate 42.

The leading end 17 of the belt is folded transversely at a predetermined point to form the loop 16 automatically after the leading belt end has been properly positioned in the folding means 27, as best seen in FIGS. 5 and 6. Herein, the belt is centered between a pair of upstanding guide means in the form of a pair of eccentrics 105 each of which is mounted on a bolt 107 threaded into the underlying plate 90. After loosening the bolts 107, a common gear (not shown) meshed to gears (not shown) fixed to undersides of the respective eccentrics is turned to locate the belt engaging walls of the eccentrics at the desired positions relative to the sewing needle 140 (FIG. 8) of the sewing machine 30 and the folding means 27 so that the longitudinally extending edges 108 or 109 of the belt are properly located during and after folding.

During infeed of the belt 12, the belt leading end 17 travels beneath a pair of fold fingers 110 which are spaced above a support pad 112, as best seen in FIGS. 5 and 6. The leading end of the belt is folded by a folder or turnover 115 which is pivotally mounted for turning about a horizontal axis through approximately 180 degrees to form a loop in the belt at the fingers 110, as will be seen in the illustrations in FIGS. 5 and 6. Herein, the folder 115 is in the shape of a rectangular plate having a pair of spaced, rearwardly extending ears 117 which are apertured. As best seen in FIGS. 5 and 10, a support shaft 119 extends into the aperture in the outer ear 117 and is secured thereto by a set screw 123 so that as the shaft 119 is turned, the folder 115 also is turned. The inner ear 117 of the folder is journaled on a stub shaft fixed to the inner block 121 for rotation about the axis of the shaft 119.

A preferred actuating means 130 for turning the folder 115 comprises a fluid actuated cylinder 129 which operates a rack and pinion means 131 comprising a rack 137 and a pinion 133, the latter being fixedly secured to the shaft 119. When the piston rod 135 for the actuating cylinder retractor 129 is retracted, as shown in FIG. 5, the rack 137 secured to the piston rod will have turned the pinion 133 and the shaft 119 to pivot the folder 115 rearwardly to a position to receive the leading end 17 of the belt. Then, with actuation of cylinder 129 following interruption of the light beam of the photocell means 85, the cylinder 129 extends its piston rod 135 causing the rack to turn the pinion and the shaft 119 thereby rotating the folder 115 about the axis of the shaft 119 which is slightly offset of the axis of the folding ears 110. The folder 115 will remain in this FIG. 6 position until the belt is clamped within the sewing machine 30.

In this preferred embodiment of the invention, the now folded belt end is shifted into the sewing station to a position underlying the sewing needle 140 (FIG. 8) having a clamping foot 141 which will clamp the portion of the upper ply 14 extending beyond the leading edge 143 of the folder 115, as best seen in FIG. 6. Preferably, a shuttle means 150 (FIGS. 8 and 9) carries the entire folding means 27 including the actuating folding cylinder 129, folder 115, and folding fingers 110 forwardly to bring the folded belt end under the needle 140 and the clamping foot 141 of the first sewing machine 30.

More specifically, as best seen in FIGS. 8 and 9, the shuttle means 150 comprises an upstanding shuttle plate 151 to which is secured a block 152 by fasteners 149. The block 152 carries the bottom plate 90, folding cylinder 129, the rack 137, the pinion 133 and the shaft 119. The horizontal bottom plate 90 which carries the blocks 121 and the folding ears 110 is secured to the block 121 by fasteners 156. Both the block 152 and horizontal plate 90 are attached in a cantilever fashion to one upper side of the shuttle plate 151 and project laterally therefrom. At its lower end, the shuttle plate 151 is secured to a threaded end of a horizontally extending piston rod 153 of a pneumatic cylinder means 154 mounted on a stationary bracket 155 secured to a portion 156 of the main frame. The bracket 155 includes a pair of upstanding bracket plates 159 and 160 between which extends a bottom horizontal plate 161 to define a U-shaped support for the cylinder 154 and a pair of horizontally extending parallel guide rods 162 for the shuttle plate. More specifically, the threaded end of the piston rod is threaded into a threaded bore in upstanding plate 160 and a lock nut holds the position of the piston rod, the pair of elongated guide bores in the shuttle plate slidably receive the pair of guide rods 162 and guide the shuttle plate for rectilinear fore and aft movement. A shaft 166 (FIG. 8) is threaded in the plate 160 and stops the rightward travel of the shuttle. Thus, it will be seen that as the piston extends, the shuttle means 150 carries the folder 115 and the folding fingers 110 to the right, as viewed in FIG. 9 to place the looped belt end under the sewing machine clamping foot 141. After the foot 141 of the needle clamps the belt loop, the cylinder 154 is actuated in the opposite direction to retract the piston rod 152 returning the folding fingers 110 and the folder 115. The folding fingers which were within the hollow opening 11 of the belt loop 16 are pivotally mounted to turn inwardly and release the belt loop during this retrograde movement of the folding fingers, as best seen in FIG. 10. The folding fingers are pivoted on upstanding pivot pins 160 extending into the blocks 121. Preferably, the fingers are biased by springs, not shown, disposed within the blocks 121 to project outwardly toward each other, as shown in FIG. 10, so as to be in position for folding the belt. During the retraction movement of the folding means, the belt loop 16 cams the fingers 110 into slots 163 in the blocks 121.

The preferred sewing machines 30 and 36 are each of conventional design and manufacture and are available from Singer Sewing Machine Company, Singer Model No. 269, and have been modified by Copper Machine Co., Inc., of Chicago, Ill., and identified by the latter as Style ZZ & B-FLY. Each sewing machine has a sewing head 167 mounted on the common top plate 42 in which is an opening 169 (FIG. 3) for receiving a belt drive 170. A motor 171 (FIG. 1) drives the belt drive 170 for the first sewing machine 30 and a similar motor (not shown) drives the belt drive 170 for the second sewing machine 36. Each sewing machine has a conventional shuttle which carries and shifts the looped belt relative to the reciprocating needle to form the respective stitch patterns 18 and 20. A circular cam, which controls the movement in the shuttle, is not shown as it is a conventional part of the sewing machine. Beneath the circular cam is the conventional bobbin carrying case having the bobbin with the thread. Each of the sewing machines 30 and 36 is provided with an automatic bobbin changing mechanism which is preferably of the kind shown in co-pending patent application Ser. No. 876,270 entitled "AUTOMATIC BOBBIN CHANGER" filed Feb. 9, 1978.

The preferred transfer means 32 for shifting the belts laterally between the sewing machines 30 and 36 comprises a carrier formed with a plurality of reciprocating pusher bars 183, 184 and 185 (FIG. 12) each having a plurality of upstanding belt engaging push shoulders 181. As best seen in FIG. 11, each bar has a plurality of push shoulders 181 each of which will abut and push a longitudinally extending edge 108 of one of the respective belts **12*b*, 12*c*, 12*d*, 12*e* and 12*f* resting on the top plate 42. The pushing shoulders on each of the bars are aligned with shoulders on the other bars to provide three spaced locations for pushing each belt. The respective bars are disposed within and guided within elongated slots 187 formed at the top plate 42 with the push shoulders projecting above the plane of the top plate 42**.

The transfer means including the transfer bars 183, 184 and 185 is reciprocated by an actuating pneumatic cylinder 189 (FIGS. 1, 11 and 12) which has a piston 191 bolted to a depending leg of a channel-shaped bracket 193 connected to a cross bar 195 extending beneath and connected to each of respective transfer push bars 183, 184, 185. As best seen in FIG. 1, the cylinder 189 is secured to a support block 194 fastened to the underside of the top plate. Each of the transfer bars is secured by threaded fasteners 193, as best seen in FIG. 11, to the cross bar 195 and it is secured by fasteners 196 to the bracket 193 connected to the piston rod 191. The latter is retracted within the cylinder 189 during the sewing operations; and, when it is desired to transfer a belt **12*b* from the first sewing station and to transfer a belt 12*f* to the second sewing station, the pneumatic lines 199 receive air under pressure to extend the piston rod 191 to the right, as viewed in FIG. 11, thereby shifting angle bracket 193 and the attached pusher bars 183, 184 and 185 to the right. The retraction of the piston rod returns the pusher bars to the solid line position, shown in FIG. 11, and an inclined cam surface 201 is provided on the reverse side of each of the upstanding push shoulders 181 for camming upwardly an associated succeeding belt as the transfer bars return to their original positions. As puch shoulders pass the left edges 108 of the belts, the belts drop from the sloped cam surfaces 201 to positions in front of the shoulders 181** for the next feeding cycle.

The belts on the top plate 42 are held against skewing, shifting or misalignment during a transfer operation by a holddown means 205 (FIGS. 4 and 12) which comprises a series of transversely extending, parallel holddown rods 208, 209 and, as best seen in FIGS. 4 and 12, abutting the top sides of the belts. A holddown flange 211 (FIG. 12) also engages the top of the respective belts at a location adjacent the folded leading end 17 of the belts to assure that the folded end does not skew before it receives a butterfly stitch 20. As best seen in FIGS. 3 and 4, a short holddown bar overlies the first two belts **12*b* and 12*c* at a location adjacent the first sewing machine 30. Suitable brackets 216 and 218 secured to the top plate 42 support the holddown rods and flange at the desired spacing above the top plate 42**. Thus, it will be seen that the belts are held and captured by the holddown means as they are moved laterally from the first to the second sewing station.

The second sewing machine 36 also includes a sewing needle (not shown) for forming the protection stitch which is preferably in the form of a butterfly stitch 20. As explained previously, the 168 individual stitches needed to make the individual lines of stitches shown for the butterfly stitch of FIG. **2*a* requires a considerable period of time and during this stitching operation and time interval an incoming belt 12*a* may be fed inwardly to the folding station 24 folded by the folding means 27 and shifted by the shuttle means 150 under the sewing needle 140 and receive a zigzag stitch 18. This is all accomplished before the butterfly stitch has been completed. When the butterfly stitch is completed, the discharge feed means 38 is actuated to lower the discharge feed wheel 225 (FIGS. 1 and 3) to engage the belt 12*g*. The discharge feed wheel 225 is identical to the infeed wheel 41 except that its direction of rotation is opposite to the direction of rotation of the infeed wheel 41. Preferably, the feed wheel 225** is mounted on a shaft 227 journaled for rotation in a pair of housing plates 228 and 229 in a housing 230 pivotally mounted for turning about the axis of the drive shaft 53. The housing 230 includes another upstanding intermediate wall 236 and a top plate 238. The gear 231 fixed to the drive shaft 53 engages an idler gear 232 mounted in the housing and the idler gear engages a gear 233 (FIG. 3) fixed to the shaft 227 to turn the feed wheel 225 continuously. The idler gear 232 causes the reverse feed direction of rotation for the feed wheel 225. As best seen in FIG. 1, an actuating cylinder 237 is connected to a depending arm 239 on the housing plate 228 to pivot the housing 230 and the feed wheel 225 into and from engagement with the belt 12*g*.

In addition to the sewing stations 29 and 34, which have been described above, a third sewing station (not shown) may be added to sew on a label to the belt. The label bears information relating to the safety belt system and is usually a cloth label of rectangular shape which is stitched about its four sides to the belt. For instance, the label may be stitched to the belt by another sewing machine located intermediate the sewing machines 30 and 36 and during less time than is required to sew the butterfly stitch. Thus, from a time and machine operator standpoint, further efficiencies may be obtained.

The preferred control circuit means 250 for operation of the actuation cylinders and time relationship to each other is a pneumatic fluid control system such as illustrated in FIG. 13 although it is to be recognized that other control systems including electric control circuits may be used in lieu of the pneumatic system now to be described. Pressurized air is fed over line 245 through a filter, regulator and lubricator to a high pressure power line 259 which is connected to each pair of control valves for each actuating cylinder as will be described in detail. A dry supply of air for operating the logic is directed over line 249 to the respective logic devices, as will be explained in detail.

Referring now to FIG. 13, the actuating cylinder 67 for positioning the web in-feed roller 41 is operated by the pressurized air coming into port "A" a pneumatic flip-flop logic element 251 which goes on and passes air over line 253 to "Not" logic element 255 which goes on and passes air to operate a spring-biased control valve 257 from its "off" position to an "on" position. This allows air to flow from the high pressure power source line 259 through the inlet end across line 261 to the cylinder 67 to force the piston to shift to the position to move downwardly to feed in the seat belt into the first sewing machine 30, when the belt is in position to feed.

The preferred logic elements are commercially available from Aro Corporation of Bryan, Ohio. Each of the control valves is normally spring biased to connect a port to exhaust until operated by air to a position which allows high pressure air from supply line 259 to be connected to the output port and line leading to the actuating cylinder.

When the seat belt has been fed so that the leading end is observed by the leading end detector means 85, the latter operates an electrically operated solenoid valve 263 to allow air to flow over line 265 to one side of AND logic element 267 (the other side of which has been previously operated, as will be explained) and logic element 267 then passes air to operate flip-flop logic element 269 to operate "Not" logic element 271 in line 273 which will cause operation of the fold or turnover cylinder 129. More specifically, air passing through line 273 goes to control valve 275 to operate the same so that air flows from the power source 259 through the valve and attached line 277 to the cylinder 129 to extend the piston rod 135 and through the rack and pinion gear turn the folder 115 to fold the belt. Air in line 273 also flows to line 279 to a delay logic element 281 in line 283 leading to "Not" logic element 285 which controls the shuttle operating cylinder 154 for moving the shuttle means 150 to bring folded seat belt beneath the sewing machine foot 141. More specifically, air from the "Not" logic element 285 flows to the control valve 287 to reposition the same to connect power source air line 259 to line 289 to drive the piston 153 to shift the shuttle means to carry the seat belt beneath the sewing machine foot 141. The air passing from delay 281 also flows through line 291 to another delay 293 in line 295 which is "Not" logic element 297 connected by a line 298 to the sewing machine 30 at a cylinder which operates the clamping foot 141 of the sewing machine 30 causing it to move downwardly to clamp the folded seat belt for a sewing operation.

Air from the delay 293 also flows through line 299 leading to another delay logic element 301 which is connected in line 303 leading to inhibit "Not" logic element 285 which, when inhibited, stops the flow of air to control valve 287 and its associated return control valve 307. The valve 307 is biased to return to the state illustrated and thereby connects the air supply therethrough to the other side of the cylinder 154 to return the shuttle means 150 to its belt receiving position. Also, air from line 303 inhibits "Not" logic element 271 and cuts air flow off on line 273 and line 309 allowing return of control valves 275 and 308 whereby the return valve 308 connects power air line 259 to the folder cylinder 67 to pivot the folder plate 115 to a flat position to receive the next seat belt.

Line 303 also passes air over line 317 to the next delay logic element 315 in line 318 which leads to "Not" logic element 319 leading to the sewing machine to provide an air impulse to start the machine sewing operation. After a few stitches, the machine will continue sewing although the air pressure is no longer on line 318. To provide the short period of air impulse to the machine 1, a delay logic element 323 is connected by line 325 to line 318. After the delay 323 times out, it passes air over line 326 to inhibit the "Not" logic element 319 so that the start machine signal is only an air impulse to start the sewing machine operation.

Air from the delay 323 also passes over line 325 to one side of an AND gate logic element 327 which awaits a signal from the first sewing machine completion. When the first machine is completed, it operates a valve 329 to provide air to the other side of the AND gate 327 to turn it on and pass air to operate flip-flop 331 in line 333 which passes air to "Not" gate 335 leading to "OR" logic element 337 leading to control valve 339 which operates the belt transfer cylinder 189 for the belt transfer means which shifts the seat belts between the first and second sewing machines. A transfer cylinder 189 is normally in its intermediate zero rest position when no air signal is applied to the valve 339. However, with the signal applied from the OR logic element 337, the power air from line 259 passes through the now open control valve 339 to move the pusher bars 183, 184 and 185 to a position to the left of the seat belts, shown in FIGS. 3 and 4, and in position to shift the recently sewn seat belt from the first sewing machine 30. Air from the line 333 also passes over line 341 to one side AND logic element 343 which awaits a second signal from the second sewing machine 36 that it has completed its sewing operation before trying to feed another belt thereto. The second sewing machine 36 is the master and the first sewing machine 30 is the slave. Assuming an air signal over line 429 from the second sewing machine, air passes through AND logic element 343 and through delay 345 to operate flip-flop logic element 347 which supplies control logic air over line 351 to control valve 353 which then delivers power driving air to the belt discharge feed lower cylinder 237 to cause it to drop discharge feed wheel 225 onto the top of the belt at the second sewing machine and to thus feed it therefrom. Air from the line 351 also travels over line 359 to delay logic element 361 in line 363 leading to a "Not" logic element 335 in line 333 to set the same to its inhibit position, while air goes over line 363 to "Not" logic element 365 in line 367 which leads to control valve 369 and sets the latter to pass air from the air power line 289 into the air cylinder 389 to cause the latter to shift the pusher bars to shift a belt from sewing machine 30 and another belt into the second sewing machine 36.

At this time, the flip-flop logic elements 251, 269 and 331 will be reset. More specifically, the air flowing from the "Not" logic element 365 also flows through line 366 to the "f" and "d" ports of the flip-flop 251 to reset the same which then allows air to flow over line 368 to flip-flop 269 to rest the same. Air from the latter passes over line 388 to reset flip-flop 331. Thus, each of the flip-flops 251, 269 and 331 has been rest to its "off" position.

Air from the line 363 also passes over line 371 to delay 373 in line 375 which passes air over line 377 to cause the transfer cylinder 189 to return to its intermediate position and thus remove the transfer bar from the second sewing machine 36. This is achieved by air from line 377 passing to operate "Not" logic element 379 in line 381 to pass air through OR logic element 337 to position valve 339 to pass power air from line 259 causing the cylinder 189 to shift its piston to shift the transfer means 32 to the intermediate or "Zero" position. The transfer means shifts to engage and operate limit switch valve 383. This limit switch valve 383 is in line 385 which leads to one side of AND gate 387, the other side of AND gate 387 having received air from over line 385 which is connected to line 375. Line 375 also supplies air to the second machine's clamp down or foot mechanism 393 through "Not" logic 391. During this time, the AND gate 387 is passing air to operate the flip-flop element 393 in line 395 and to operate "Not" logic element 397 to cause a machine start mechanism 396 to start the second sewing machine 36. Again, the air to start the second sewing machine need be only an impulse sufficient to start the first several stitches after which the sewing machine controls take over to finish the desired sewing pattern. To provide an impulse, air from line 395 also passes over line 399 and through delay logic element 401 therein to inhibit the "Not" logic element 397 and thus provide only a short air impulse to start the second sewing machine 36.

Because the first sewing machine station operations including the belt feed in, belt folding, and belt sewing take less time than the butterfly stitch, the first sewing machine's operation may be signalled to commence at the start of the second sewing machine's sewing operation. To this end, air passes from "Not" logic element 397 over line 398 which leads to the first flip-flop 251 which begins the belt feed in operation for the first sewing machine 30. Air from the delay logic element 401 also passes through line 403 to one side of AND logic element 405 which awaits signal from the second sewing machine from air logic element 407 signifying that the butterfly stitch pattern has been completed.

It will be recalled that the second sewing machine 36 is a master sewing machine and that the first sewing machine must always wait until the second sewing machine has completed its operation before there is a belt transfer. With the AND gate 405 actuated, air may pass through line 409 to flip-flop element 411 in line 413 which operates through a delay 415 to send a reset signal over line 417 to reset each of the flip-flops 347, 393 and 411 for the second sewing machine. More specifically, air flows over line 417 to "f" and "d" ports of flip-flop 347 and then through line 419 to flip-flop logic element 393 and then over line 421 to flip-flop logic element 411. Thus, these flip-flops are all reset to "off" positions.

After resetting flip-flop 411, air passes over line 423 to the AND logic element 343 to initiate another belt transfer and belt discharge operation assuming that the first sewing machine operations have been completed as will be indicated by air having already been present at the other side of the AND gate over line 341.

In addition to the above described elements, manually operated controls are also provided. A manually operated switch 427 in line 429 leading to logic elements 431 and 433 control a latch relay 435 which allows the power air to flow therethrough in line 259 to each of the control valves above described. An emergency stop switch 437 is connected to logic elements 431 and 433 to switch the latch valve 435 to its "off" position thus terminating all air flow through power line 259 to various operating cylinders.

From the foregoing, it will be seen that there is provided a new and improved method and apparatus for sewing loops in seat belts. The apparatus is particularly efficient in that the sewing time on the butterfly stitching machine is maximized. The apparatus is relatively simple, inexpensive and effective.

While a preferred embodiment has been shown and described, it will be understood that there is no intent to limit the invention by such disclosure but, rather, it is intended to cover all modifications and alternate constructions falling within the spirit and scope of the invention as defined in the appended claims.

What is claimed is:

1. A method of folding an end of safety belts to form a loop and sewing the folded end at a first sewing station and sewing the belt at a nearby second sewing station, such method comprising the steps of:

sewing at the second station a previously looped first belt sewn at a first sewing station with a number of lines of stitches in a predetermined second stitch pattern to provide strength to resist tensile forces applied to the belt loop, during the time of sewing the second stitch pattern folding an end of another belt by a folding device to form a loop therein at a folding station, during the time of sewing the second stitch pattern and in timed relationship thereto sewing a first stitch pattern to hold the superimposed plies of the belt looped end together, and shifting the other belt from the first sewing station toward the second station and shifting the first belt from the second station so that the second sewing station is kept occupied by sewing through a preponderance of the time of its operation.

2. A method in accordance with claim 1 in which the sewing of the plies together at the first station comprises the step of sewing a line of stitches in a zigzag pattern across the belt.

3. A method in accordance with claim 1 in which a succession of looped belts stitched by said first station are located between said first sewing and said second sewing station and move in seriatim fashion to the second station.

4. A method in accordance with claim 1 including the step of simultaneously transferring a belt from said first sewing station and transferring another belt into said second sewing station by a common transfer means.

5. A method in accordance with claim 1 including feeding a belt into said first station simultaneously with a discharge feeding of a belt from the second sewing station.

6. A method in accordance with claim 1 including the further step of automatically changing the bobbin of said second sewing machine during the time of belt movement.

7. A method of folding a safety belt end into a loop and to sewing same to resist tensile loads applied to the loop, said method comprising the steps of:

feeding a belt to a folding station, folding an end of the belt to provide face-to-face plies to form a loop at the folding station, securing the loop plies to each other, shifting the loop end of the belt to a sewing station, sewing the face-to-face plies at the sewing station with a predetermined stitching pattern to withstand the tensile loadings to be applied to the loop, discharge feeding the sewn and looped belt from the sewing station, and changing a bobbin containing thread for a sewing machine at said second station during the time interval of feeding said belt at said second station, said step of securing the loop plies together comprising sewing them with a sewing machine and with a stitch pattern having substantially fewer stitches than the subsequent stitching operation.

8. A method in accordance with claim 7 including the step of sewing a zigzag stitch pattern to holding the leading end of the belt to a facing belt ply and sewing the plies together with a butterfly stitch pattern.

9. A method of forming and sewing a loop end in a safety belt comprising the steps of:

feeding a belt forwardly along a first path to a loop-forming station, folding over an end of said belt by a folding device at said loop-forming station to form a looped end, shifting the looped end into a first sewing station, stitching the folded plies with a first predetermined stitching pattern to hold the loop in the belt at said first sewing station, transferring the stitched and looped belt along a second path to a nearby second sewing station, sewing a second stitching pattern during the time of stitching of folded plies of another belt at said first station to permanently attach said looped belt plies at said second stitching station against separation under tensile loading of a predetermined value, and discharging said belt with said loop from said second stitching station.

10. A method in accordance with claim 9 including folding the loop, shifting the loop into said first sewing station, and sewing said first stitch pattern during the time of making the second stitching operation.

11. A method in accordance with claim 9 in which said first stitching pattern is a zigzag pattern and in which said second stitching pattern is a butterfly stitching pattern.

12. A method in accordance with claim 9 including the further step of changing a thread carrying bobbin for a second sewing machine during the time interval for discharging a belt from said second sewing station and moving another belt into position for sewing at said second sewing station.

13. An apparatus for forming and sewing a loop in a safety belt comprising:

feeding means for feeding a belt into a loop-forming station, folding means at said loop-forming station for folding an end of the belt back onto itself to form a loop defined by two plies at one end of the belt, means for sewing a first stitch to join the looped plies of the belt together at a first sewing station, transfer means for transferring said looped end of a safety belt to a second sewing station, a second sewing means at said second sewing station for sewing said loop end with a second stitch to hold said looped end plies together against a predetermined tensile loading, and discharge means for discharging said sewing looped belt end having first and second stitches joining the plies together.

14. An apparatus in accordance with claim 13 in which a succession of looped belts are disposed between said first and second sewing stations and in which said means for transferring said belt comprises means for transferring through a plurality of positions intermediate said first and second stations before inserting the safety belt into said second sewing station.

15. An apparatus in accordance with claim 14 in which said transfer means comprises a plurality of pushers each engaging one of said belts and joined for conjoint movement to shift a first belt from said first sewing station to an intermediate position and another belt at an intermediate position into said second station.

16. An apparatus in accordance with claim 13 in which said folding means comprises a retractable finger means and a turnover member for turning an end of the belt over the finger means to form said loop.

17. An apparatus in accordance with claim 16 in which a shuttle means carries said folding means and the folded belt to said first sewing machine.

18. An apparatus in accordance with claim 13 in which a flat surface means supports said belts for movement in a first direction by said feeding means and for movement in a lateral direction by said transfer means and then for movement in an opposite direction from said infeed direction for discharge.

19. An apparatus in accordance with claim 13 in which said feeding means comprises a feed wheel for feeding the web forwardly until a length sensor means determines that the belt is in position for folding said folding means.

20. An apparatus in accordance with claim 19 in which said feeding means comprises a continuously rotating feed wheel and in which an actuating means under the control of said length sensing means shifts said feed wheel from said belt to stop feeding of said belt.

21. An apparatus in accordance with claim 20 in which said feeding means and said transfer means each comprise means for pivotally mounting the same for movement into engagement with or from engagement with a belt.

22. An apparatus in accordance with claim 21 including a clamping means for clamping a belt against movement after feeding into said folding means.

23. An apparatus in accordance with claim 18 in which a holddown means engages the upper surfaces of the belts and holds the same against said flat surface to prevent skewing of the same during lateral movements by said transfer means.

* * * * *

UNITED STATES PATENT AND TRADEMARK OFFICE

CERTIFICATE OF CORRECTION

PATENT NO. : 4,157,687

DATED : June 12, 1979

INVENTOR(S) : RAYMOND S. CISLAK

It is certified that error appears in the above-identified patent and that said Letters Patent are hereby corrected as shown below:

Column 7, line 34, "Copper" should be --Cooper--

Column 8, line 28, "puch" should be --push--

Column 12, line 53, "such" should be --said--

Signed and Sealed this

*Fifteenth* Day of *January 1980*

[SEAL]

*Attest:*

SIDNEY A. DIAMOND

*Attesting Officer*

*Commissioner of Patents and Trademarks*